US012714285B2

(12) United States Patent
Shin

(10) Patent No.: US 12,714,285 B2
(45) Date of Patent: Aug. 25, 2026

(54) FIELD-TAILORED PREFABRICATED DUST SUCTION MAT

(71) Applicant: TESTONIC CO., LTD., Ansan-si (KR)

(72) Inventor: Dong Jun Shin, Ansan-si (KR)

(73) Assignee: TESTONIC CO., LTD., South (KR)

( * ) Notice: Subject to any disclaimer, the term of this patent is extended or adjusted under 35 U.S.C. 154(b) by 483 days.

(21) Appl. No.: 18/333,395

(22) Filed: Jun. 12, 2023

(65) Prior Publication Data

US 2023/0404363 A1 Dec. 21, 2023

(30) Foreign Application Priority Data

Jun. 15, 2022 (KR) ..... 10-2022-0072965

(51) Int. Cl.
*A47L 23/26* (2006.01)
*A47L 9/00* (2006.01)
*A47L 23/02* (2006.01)

(52) U.S. Cl.
CPC ..... *A47L 23/263* (2013.01); *A47L 9/0072* (2013.01); *A47L 23/02* (2013.01); *A47L 23/266* (2013.01)

(58) Field of Classification Search
CPC ..... A47L 23/263; A47L 23/266; A47L 23/22; B08B 5/04
See application file for complete search history.

(56) References Cited

U.S. PATENT DOCUMENTS 3,786,531 A * 1/1974 Borg ..... A47L 23/263 15/310
6,505,444 B1 * 1/2003 Johnson ..... E04F 15/02194 428/53

(Continued)

FOREIGN PATENT DOCUMENTS

CN 106170240 A * 11/2016 ..... A47L 23/22
JP 2017035470 2/2017

(Continued)

OTHER PUBLICATIONS

English Language translation of disclosure/specification of Lee et al. (KR-101330699-B1).*

*Primary Examiner* — Bryan R Muller

(57) ABSTRACT

Disclosed is a field-tailored prefabricated dust suction mat that absorbs and removes dust from the soles of visitor's shoes. A dust suction mat according to the present disclosure includes unit mats continuously connected to each other in a first direction, wherein each of the unit mats has a plurality of through holes for dust suction and through hole opening/closing means for opening or closing the through holes, the unit mats have lengths in a second direction perpendicular to the first direction, which are equal to each other, and widths in the first direction, which are equal to or different from each other, and an overall width of the dust suction mat in the first direction is adjusted according to the number of the unit mats, which are continuously connected to each other in the first direction. According to the present disclosure, dust suction mats can be custom-made on site in various sizes, depending on site conditions such as surrounding environment or spatial situation of an installation site, or consumers' requirements, and even when dust suction mats are manufactured in the form of ready-made products in a factory, it is possible to quickly respond to site conditions or customers' demands for size change without extensive equipment replacement or change.

8 Claims, 9 Drawing Sheets

(56) References Cited

U.S. PATENT DOCUMENTS

| | | | | |
|---|---|---|---|---|
| 10,159,399 | B2 * | 12/2018 | Choi | A47L 23/263 |
| 10,781,595 | B2 * | 9/2020 | McIntosh | E04F 15/0215 |
| 2017/0326810 | A1 * | 11/2017 | Neill | B29C 66/21 |
| 2020/0113411 | A1 * | 4/2020 | Shin | B08B 5/04 |

FOREIGN PATENT DOCUMENTS

| | | | | |
|---|---|---|---|---|
| JP | 2020516435 | | 6/2020 | |
| KR | 100821510 | | 4/2008 | |
| KR | 101096161 | B1 * | 12/2011 | A47L 23/24 |
| KR | 10-1330699 | | 11/2013 | |
| KR | 101330699 | B1 * | 11/2013 | A47L 23/263 |
| KR | 10-1477217 | | 12/2014 | |
| KR | 10-1486754 | | 1/2015 | |
| KR | 10-2033114 | | 10/2019 | |

* cited by examiner

FIELD-TAILORED PREFABRICATED DUST SUCTION MAT

BACKGROUND OF THE INVENTION

Technical Field

The present disclosure relates to a dust suction mat which is installed at the entrance of a building, etc. so as to vacuum and remove dust attached to the soles of shoes and, more particularly, to a field-tailored prefabricated dust suction mat which can be custom-made on site in various sizes according to site conditions such as surrounding environment or spatial conditions of an installation site, or customers' demands.

Background

Recently, fine dust in the air has emerged as a serious social problem. Inhalation of air pollutants emitted from factories or automobiles can cause various respiratory diseases and, in severe cases, death.

Also, since the atmosphere circulates around the world, the efforts of one country cannot completely solve the problem of fine dust in that country and thus joint research and cooperation between countries to reduce fine dust is also urgent.

Therefore, each country is conducting a lot of policy efforts and research to reduce airborne fine dust, but it is true that there is relatively little interest in indoor fine dust, which is more serious than fine dust in the air.

In addition, the problem of indoor fine dust so far has been focused only on removing dust that has already flowed in through air purifiers, etc., and it is true that there has not been much interest in fundamentally blocking or reducing the inflow of fine dust into the room.

Recently, a dust suction mat has been known as a part of methods for blocking or reducing the inflow of fine dust into the room, which is installed at the entrance of a building and suctions dust from the soles of visitors' shoes like a vacuum cleaner.

Such a dust suction mat uses the rotational force of a powerful motor so as to draw the air inside the mat out of the mat and lower the pressure inside the mat, so that outside air is suctioned into the mat and in this process, dust and dirt from the soles of shoes are also suctioned into the mat.

However, there are problems in that as the known conventional dust suction mats are shipped after being manufactured in the form of off-the-shelf products in factories according to certain standards, an unnecessarily large size dust suction mat must be installed and operated, or depending on site conditions, the area of such a dust suction mat is greater than an allowable installation area, so installation is impossible or many restrictions are imposed on installation.

Accordingly, there is a need for a dust suction mat that can be customized in various sizes at the site according to site conditions such as surrounding environment or spatial situation of an installation site, or the request of the consumer.

PRIOR ART DOCUMENT

Patent Document

Patent Document 1 Korean Reg. Patent Pub. No. 10-1477217 (Published, Dec. 29, 2014)

SUMMARY OF THE INVENTION

Problems to be Solved

The present disclosure was derived to solve the above conventional problems, and it is an object of the present disclosure to provide a field-tailored prefabricated dust suction mat which can be custom-made on site in various sizes according to site conditions such as surrounding environment or spatial situation of an installation site, or consumers' requirements.

Technical Solutions

In order to achieve the above objects, in a dust suction mat that absorbs and removes dust from soles of visitor's shoes, there is provided according to the present invention a field-tailored prefabricated dust suction mat, characterized in that the dust suction mat includes unit mats continuously connected to each other in a first direction, each of the unit mats has a plurality of through holes for dust suction and through hole opening/closing means for opening or closing the through holes, the unit mats have lengths in a second direction perpendicular to the first direction, which are equal to each other, and widths in the first direction, which are equal to or different from each other, and an overall width of the dust suction mat in the first direction is adjusted according to number of the unit mats, which are continuously connected to each other in the first direction.

The unit mats applied to the present disclosure may include one pair of outer unit mats spaced apart from each other at a distance, and at least one or more intermediate unit mats positioned between the one pair of outer unit mats.

In addition, each the unit mats may include a lower plate, which is formed in a rectangular shape with a second direction length longer than a first direction width and has traverse side walls formed along both side edges in the first direction, an intermediate plate, which is formed in a shape corresponding to that of the lower plate and has a plurality of through holes, a plurality of fastening projections for serving as spacers for separating the intermediate plate from the lower plate by a predetermined distance, and a finishing upper plate, which is formed in a shape corresponding to that of the lower plate, has a plurality of through holes matched one by one to the through holes formed in the intermediate plate, and covers the intermediate plate from the top.

Herein, the through hole opening/closing means may be installed between the lower plate and the intermediate plate so as to match the through holes of the intermediate plate and the finishing upper plate one by one, and the through hole opening/closing means partially protrude upward from the top of the finishing upper plate through the through holes formed in the intermediate plate and the finishing upper plate.

In addition, each of the through hole opening/closing means may include a ball disposed under the intermediate plate so as to correspond to the through holes of the intermediate plate and the finishing upper plate one by one, and a spring for applying elasticity to the ball at the bottom of the ball so that the ball comes into close contact with a corresponding through hole and a part of the ball protrudes upward from the top of the finishing upper plate.

According to the present disclosure, the lower plate of the outer unit mat may further include a longitudinal side wall formed along one side edge in the second direction, and rubber packings may be attached to the longitudinal side wall and the traverse side wall so as to ensure airtightness along inner surfaces of the longitudinal side wall and the traverse side wall.

In addition, partitions may be placed at a boundary part, where lower plates of neighboring unit mats are in contact with each other, and spatially divide the two lower plates, which are in contact with each other, from each other so as to form a dust suction path, and when several lower plates are in contact with each other, partitions may be disposed at boundary parts where two lower plates are in contact with each other so that dust suction paths are continuously formed in a zigzag shape.

Herein, the partitions may have hollow parts formed in the second direction, recess parts may be formed on opposite sides of two neighboring intermediate plates so as to form a slit-shaped coupling hole corresponding to the hollow part, and binding flanges respectively formed on side edges, which are opposite to or in contact with each other, of two neighboring finishing upper plates may be simultaneously inserted into the coupling hole formed by the recess parts of the two neighboring intermediate plates so as to be positioned in the hollow part.

In addition, a flow guide member may be installed at a corner portion of a connection path part, where two neighboring dust suction paths are connected to each other, and have a curved concave guide surface.

The present disclosure may further include a finishing member installed along outer edges of a dust suction mat in the form of an assembly in which the unit mats are continuously connected to each other in the first direction, wherein the finishing member may include one pair of traverse finishing members installed along the outer edges of the assembly type dust suction mat in the first direction, one pair of longitudinal finishing members installed along the outer edges of the assembly type dust suction mat in the second direction, and corner finishing members installed at corners of the assembly type dust suction mat where the traverse finishing members and the longitudinal finishing members meet.

Advantageous Effects

As for the field-tailored prefabricated dust suction mat according to embodiments of the present disclosure, owing to the prefabricated configuration in which the unit mats are assembled together, dust suction mats can be advantageously custom-made on site in various sizes according to site conditions such as surrounding environment or spatial situation of an installation site, consumers' requirements or the like.

In addition, even when dust suction mats are manufactured and shipped in the form of ready-made products in a factory, it is possible to quickly respond to site conditions or consumers' demands for size change advantageously, without extensive equipment replacement or change.

DESCRIPTION OF THE INVENTION

Figure 1:
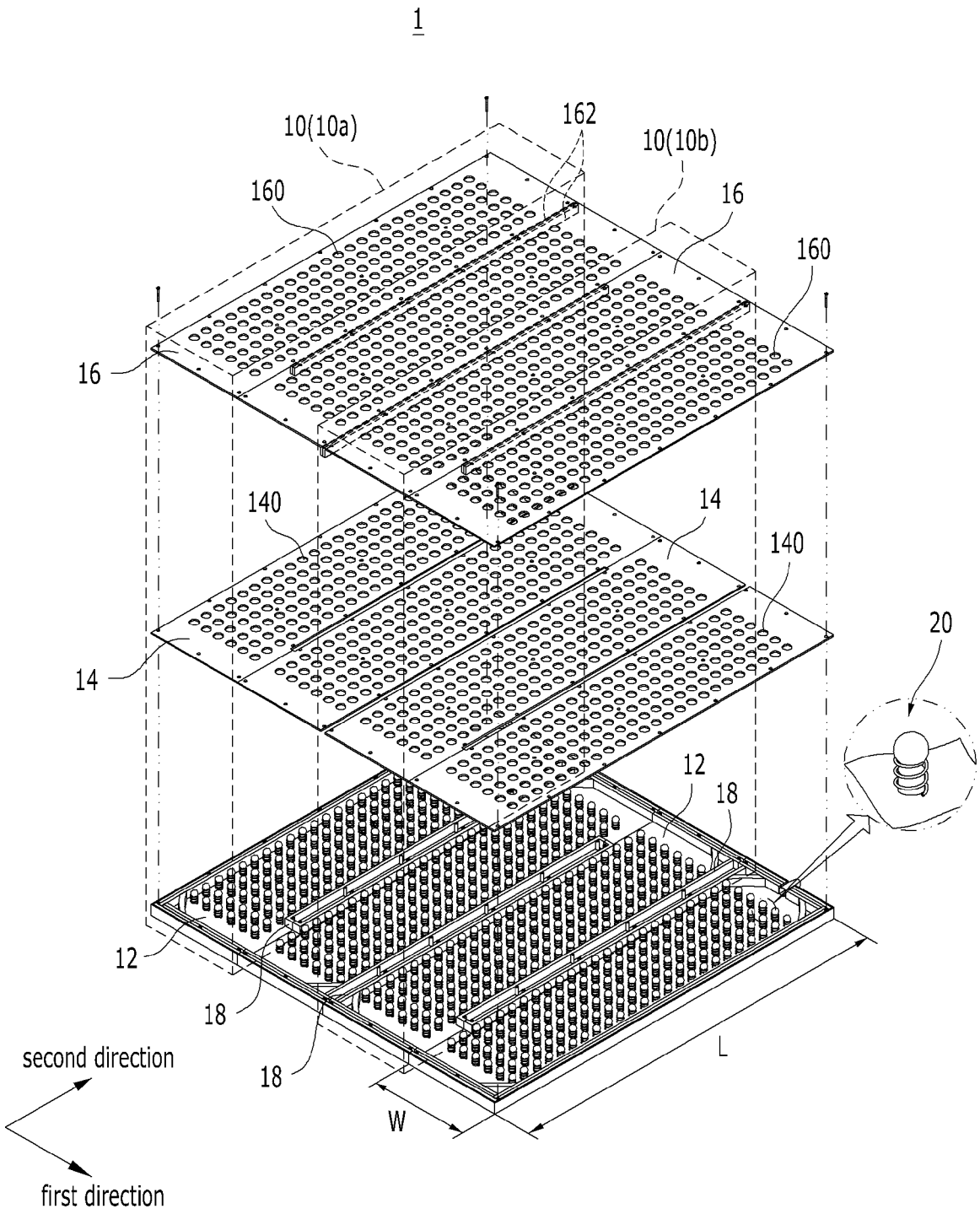
FIG. 1 is a partially exploded perspective view of a field-tailored prefabricated dust suction mat according to an embodiment of the present disclosure.

Hereinafter, a dust suction mat having a sterilization function according to a preferred embodiment of the present disclosure will be described in detail with reference to the accompanying drawings.

In describing the present invention, terms used in herein are only used to describe specific embodiments, and are not intended to limit the present invention. Singular expressions include plural expressions unless the context clearly dictates otherwise.

In addition, it should be understood that the terms "include" or "have" herein are intended to designate that features, numbers, steps, operations, components, parts, or combinations thereof described herein exist and do not preclude the possibility of the presence or addition of one or more other features, numbers, steps, operations, components, parts, or combinations thereof.

Also, terms such as first and second may be used to describe various components, but the components should not be limited by the terms. These terms are only used for the purpose of distinguishing one component from another.

In the description with reference to the accompanying drawings, same reference numerals will be given to same components, and overlapping descriptions thereof will be omitted. In addition, in describing the present disclosure, if it is determined that a detailed description of a related known technology may unnecessarily obscure the gist of the present disclosure, the detailed description thereof will be omitted.

Figure 2:
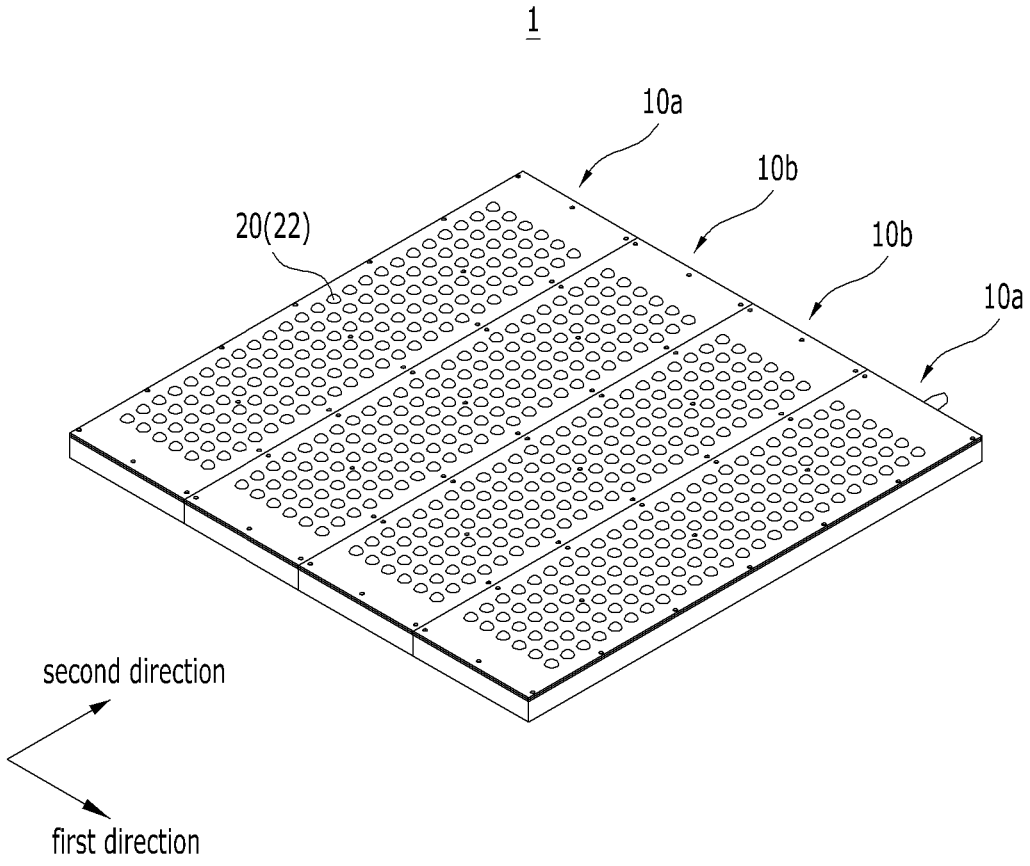
FIG. 2 is a combined perspective view of the field-tailored prefabricated dust suction mat shown in FIG. 1.

FIG. 1 is a partially exploded perspective view of a field-tailored prefabricated dust suction mat according to an embodiment of the present disclosure, and FIG. 2 is a combined perspective view of the field-tailored prefabricated dust suction mat shown in FIG. 1.

Referring to FIG. 1 and FIG. 2, a field-tailored prefabricated dust suction mat 1 according to an embodiment of the present disclosure is composed of unit mat 10. The unit mats 10 can be continuously connected to each other in a first direction so as to be combined, wherein each of the unit mats 10 may include a plurality of through holes 140 for dust suction and through hole opening/closing means 20 for opening or closing through holes 140, 160.

The unit mats 10 constituting the dust suction mat 1 according to an embodiment of the present disclosure may be formed such that second direction lengths L are equal to each other in a second direction that is perpendicular to the first direction and first direction widths W are equal to or different from each other in the first direction, wherein an overall width of the dust suction mat 1 in the first direction can be adjusted according to a number of the unit mats 10, which are continuously connected to each other in the first direction.

Accordingly, dust suction mats can be custom-made on site in various sizes, depending on site conditions such as surrounding environment or spatial situation of an installation site, or consumers' requirements, and even when dust suction mats are manufactured and shipped in the form of ready-made products in a factory, it is possible to quickly respond to site conditions or customers' demands for size change without extensive equipment replacement or change.

It should be noted that in the drawings, a field-tailored prefabricated dust suction mat according to an embodiment of the present disclosure is shown as being composed of four unit mats 10 as an example, but this is only an embodiment for explaining the present disclosure, and the number of unit mats 10 constituting the dust suction mat 1 according to an embodiment of the present invention is not limited to four.

The unit mats 10 applied to the present disclosure may include one pair of outer unit mats 10*a* spaced apart from each other at a distance, and at least one or more intermediate unit mats 10*b* positioned between the one pair of outer unit mats 10*a*, wherein each of the outer unit mats 10*a* and the intermediate unit mats 10*b* of the unit mats 10 may be formed in a rectangular flat shape, in which the second direction length L is longer than the first direction width W.

Figure 3:
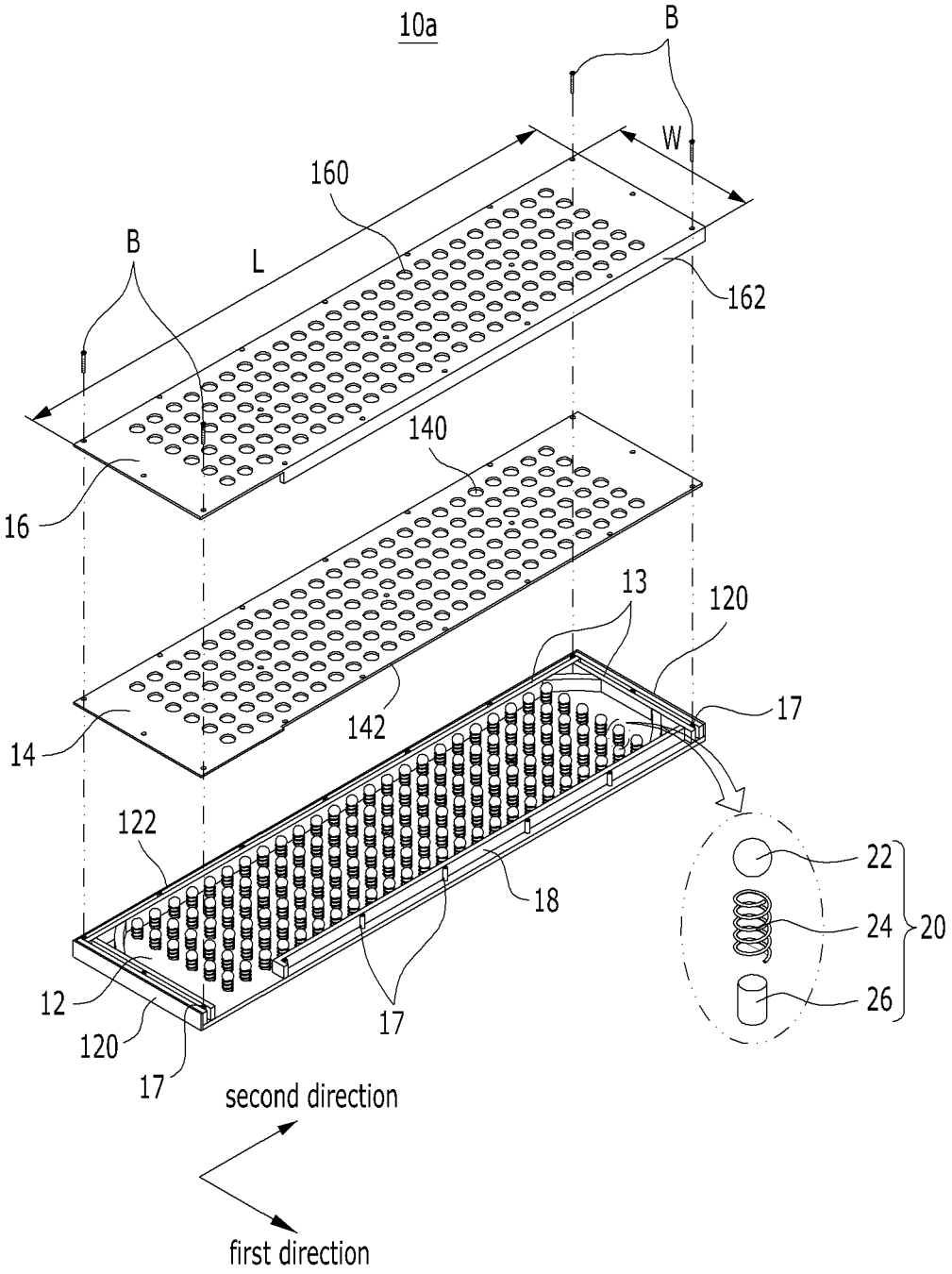
FIG. 3 is an exploded perspective view illustrating an outer unit mat among unit mats shown in FIG. 1.

FIG. 3 is an exploded perspective view illustrating an outer unit mat among the unit mats shown in FIG. 1.

Referring to FIG. 3, an outer unit mat 10*a* includes a lower plate 12 and an upper plate 16. In addition, the outer unit mat 10*a* includes an intermediate plate 14 interposed between the lower plate 12 and the upper plate 16, and fastening projections 17 to which bolts B are fastened when the upper plate 16, the intermediate plate 14, and the lower plate 12 are connected by means of the bolts B, wherein the fastening projections 17 serve as spacers between the lower plate 12 and the intermediate plate 14 so as to separate the intermediate plate 14 from the lower plate 12 by a certain distance.

The lower plate 12 of the outer unit mat 10*a* may be formed in a rectangular shape in which the second direction length L is longer than the first direction width W, and may be configured such that traverse side walls 120 are formed along both edges in the first direction and a longitudinal side wall 122 is formed along one edge in the second direction. Herein, rubber packings 13 may be attached to inner surfaces of the longitudinal side wall 122 and the traverse side walls 120 so as to prevent loss of suction power and to ensure airtightness along the inner surfaces of the longitudinal side wall 122 and the traverse side walls 120.

The intermediate plate 14 of the outer unit mat 10*a* may be formed in a shape corresponding to that of the lower plate 12 and include the plurality of through holes 140. In addition, the finishing upper plate 16 of the outer unit mat 10*a* may also be formed in a shape corresponding to that of the lower plate 12 and include the plurality of through holes 160, which are formed in same sizes and at same positions as the through-holes 140 formed in the intermediate plate 14 so as to match the through-holes 140 formed in the intermediate plate 14 one by one.

The upper plate 16 may be coupled so as to cover the intermediate plate 14 from the top. Herein, in order to couple the upper plate 16, the intermediate plate 14, and the lower plate 12, fastening screws are screw-fastened to the fastening projections 17 formed on the lower plate 12 by passing through fastening holes (reference numeral omitted) formed in each of the upper plate 16 and the intermediate plate 14 at the same time such that the fastening screws match the fastening projections 17 one by one. Therefore, the upper plate 16, the intermediate plate 14, and the lower plate 12 can be closely and firmly coupled to each other.

The through hole opening/closing means 20 may be installed between the lower plate 12 and the intermediate plate 14 so as to match the through holes 140 of the intermediate plate 14 and the finishing upper plate 16 one by one. Some parts of the through hole opening/closing means 20, that is, parts of springs 24 which will be described later, may be connected to a lower plate 12 side, and other parts, that is, parts of balls 22 which will be described later, may protrude upward from the top of the finishing upper plate 16 through the through holes 140 formed in the intermediate plate 14 and the finishing upper plate 16.

The through hole opening/closing means 20 may preferably include the balls 22 and the springs 24. The balls 22 are disposed under the intermediate plate 14 so as to correspond one by one to the through holes 140 of the intermediate plate 14 and the finishing upper plate 16. In addition, the springs 24 are for imparting elasticity to the balls 22 under the balls 22 so that the balls 22 come into close contact with corresponding through holes 140 and a part of each of the balls 22 protrudes upward from the top of the finishing upper plate 16, wherein the springs 24 can be, for example, compression coil springs.

In order to allow the balls 22 to be positioned higher than an upper surface of the upper plate 16 while being prevented from escaping to the outside through the through holes 140, the balls 22 may be formed with diameter larger than diameter of the through holes 140 so that parts of the balls 22 may protrude upward from the top of the through holes 140 formed in the intermediate plate 14 and the upper plate 16. In addition, the springs 24 for elastically supporting the balls 22 may be coupled to spring supports 26, which protrude from an upper surface of the lower plate 12 and have a height lower than that of the springs 24.

Herein, each spring support 26 may be formed in a cylindrical shape with a diameter smaller than a diameter of each spring 24 so as to be fitted into the spring 24, as shown in FIG. 3, or in a cylindrical shape with an inner diameter larger than the diameter of the spring 24 so as to accommodate a part of a lower end of the spring 24, although not shown in the drawings. The spring supports 26 may be arranged at positions where interference with the aforementioned fastening projections 17 is avoided.

Figure 4:
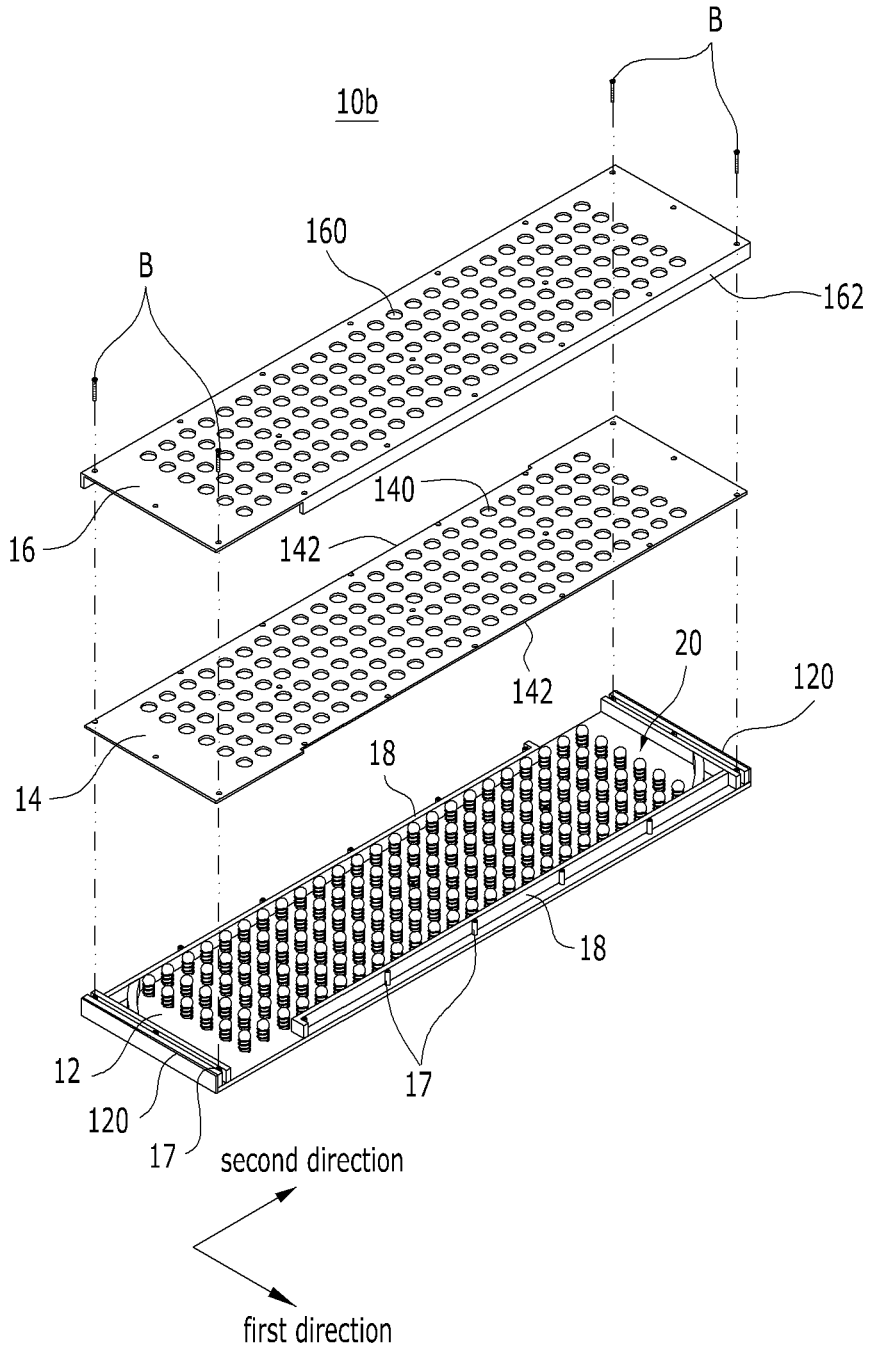
FIG. 4 is an exploded perspective view of an intermediate unit mat among the unit mats shown in FIG. 1.

FIG. 4 is an exploded perspective view of an intermediate unit mat among the unit mats shown in FIG. 1.

Referring to FIG. 4, an intermediate unit mat 10*b* also includes a lower plate 12 and an upper plate 16. In addition, the intermediate unit mat 10*b* includes an intermediate plate 14 interposed between the lower plate 12 and the upper plate 16, and fastening projections 17 to which bolts B are fastened when the upper plate 16, the intermediate plate 14, and the lower plate 12 are connected by means of the bolts B, wherein the fastening projections 17 serve as spacers between the lower plate 12 and the intermediate plate 14 so as to separate the intermediate plate 14 from the lower plate 12 by a certain distance.

The lower plate 12 of the intermediate unit mat 10*b* may also be formed in a rectangular shape in which the second direction length L is longer than the first direction width W, and may be configured such that traverse side walls 120 are formed along both edges in the first direction.

Herein, rubber packings 13 may be attached to inner surfaces of the traverse side walls 120 formed at both sides in the first direction so as to prevent loss of suction power and to ensure airtightness along the inner surfaces of the traverse side walls 120.

The intermediate plate 14 of the intermediate unit mat 10*b* may be formed in a shape corresponding to that of the lower plate 12 and include the plurality of through holes 140. In addition, the finishing upper plate 16 of the intermediate unit mat 10*b* may also be formed in a shape corresponding to that of the lower plate 12 and include the plurality of through holes 140, which are formed in same sizes and at same positions as the through-holes 140 so as to match the through-holes 140 formed in the intermediate plate 14 one by one.

The upper plate 16 of the intermediate unit mat 10*b* may also be coupled so as to cover the intermediate plate 14 from the top. Herein, in order to couple the upper plate 16, the intermediate plate 14, and the lower plate 12, fastening screws are screw-fastened to the fastening projections 17 formed on the lower plate 12 by passing through fastening holes formed in each of the upper plate 16 and the intermediate plate 14 such that the fastening screws match the fastening projections 17 one by one. Therefore, the upper plate 16, the intermediate plate 14, and the lower plate 12 can be closely and firmly coupled to each other.

The through hole opening/closing means 20 may also be installed between the lower plate 12 and the intermediate plate 14 of the intermediate unit mat 10*b* so as to match the through holes 140 of the intermediate plate 14 and the finishing upper plate 16 one by one. The through hole opening/closing means 20 provided to the intermediate unit mat 10*b* may have the same configuration as the aforementioned through hole opening/closing means 20 installed in the outer unit mat 10*a*, and thus a detailed description of the through hole opening/closing means 20 provided to the intermediate unit mat 10*b* is omitted.

Figure 5:
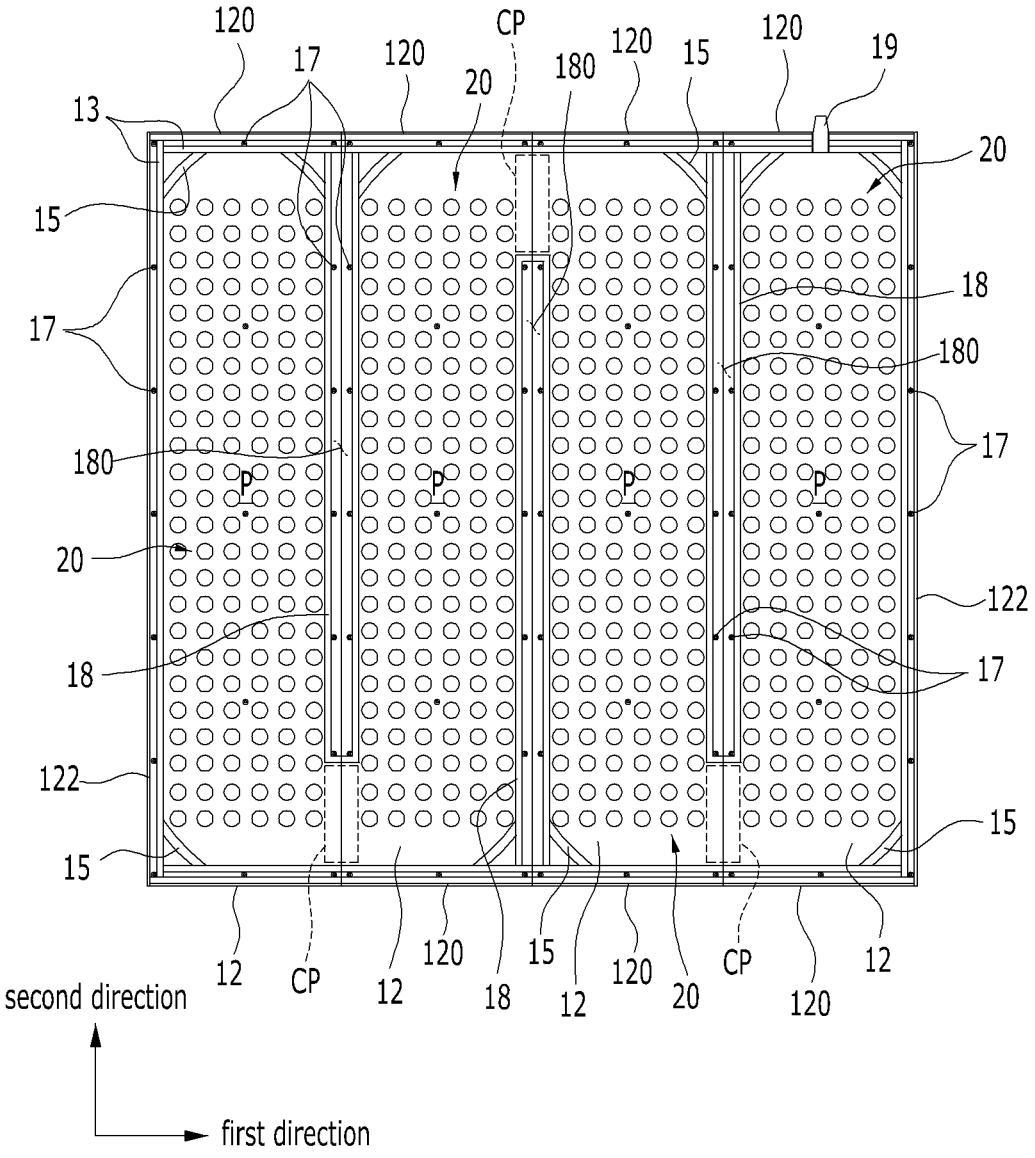
FIG. 5 is a top plan view of a state in which lower plates of the unit mats shown in FIG. 1 are coupled to each other.

FIG. 5 is a top plan view of a state in which the lower plates of the unit mats shown in FIG. 1 are coupled to each other.

Referring to FIG. 5, two lower plates 12 of neighboring unit mats 10 may be connected to each other in the first direction through a joint plate or joint, which is not shown. At this time, partitions 18 may be placed at a boundary part, where the two lower plates 12 of the neighboring unit mats are in contact with each other, and spatially divide the two lower plates 12, which are in contact with each other, from each other so as to form a dust suction path P.

When several, for example, four lower plates 12 are continuously connected to each other in the first direction as shown in FIG. 5, in order to form dust suction paths P continuously in a zigzag shape, the partitions 18 may be arranged in such a way that the positions of the partitions 18 in contact with the traverse side walls 120 are alternately changed in the boundary parts where two lower plates 12 come into contact with each other.

The partitions 18 may have hollow parts 180 formed long in the second direction. In addition, a flow guide member 15 having a curved concave guide surface may be installed at a corner portion of a connection path part CP, where two neighboring dust suction paths P are connected to each other. Therefore, when air flows from one dust suction path to the other dust suction path, air flow direction is smoothly reversed so that kinetic energy loss can be minimized.

Reference numeral 19 in FIG. 5 indicates a dust discharge pipe, which is installed to communicate with the dust suction path P of the outer unit mat 10*a* by passing through the traverse side wall 120 on one side of the lower plate 12 of the outer unit mat 10*a*, wherein the dust discharge pipe is connected to an external suction force generating means through a flexible hose or a pipe (not shown).

Figure 6:
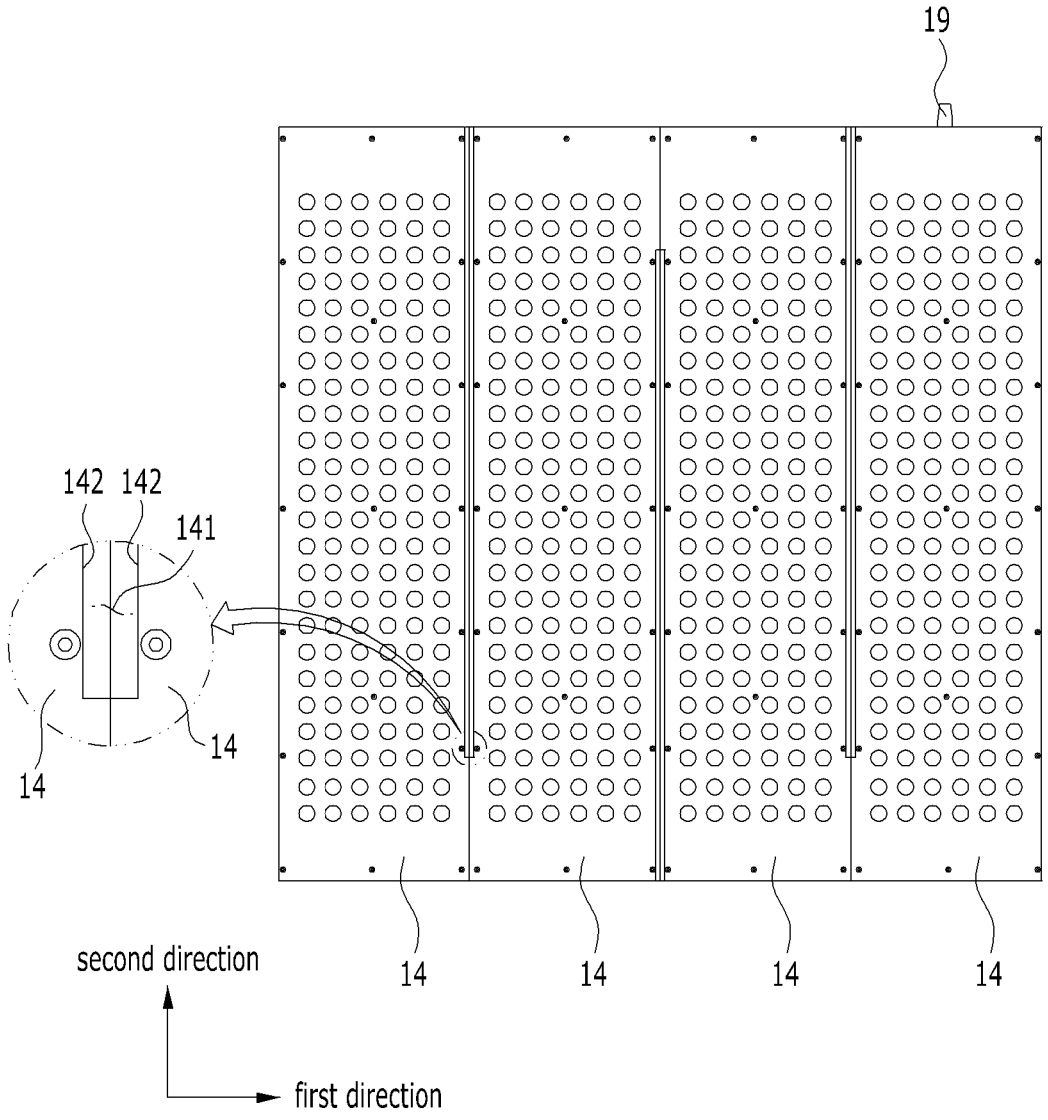
FIG. 6 is a top plan view of a state in which intermediate plates are coupled to upper portions of a plurality of lower plates continuously connected to each other as shown in FIG. 5.
Figure 7:
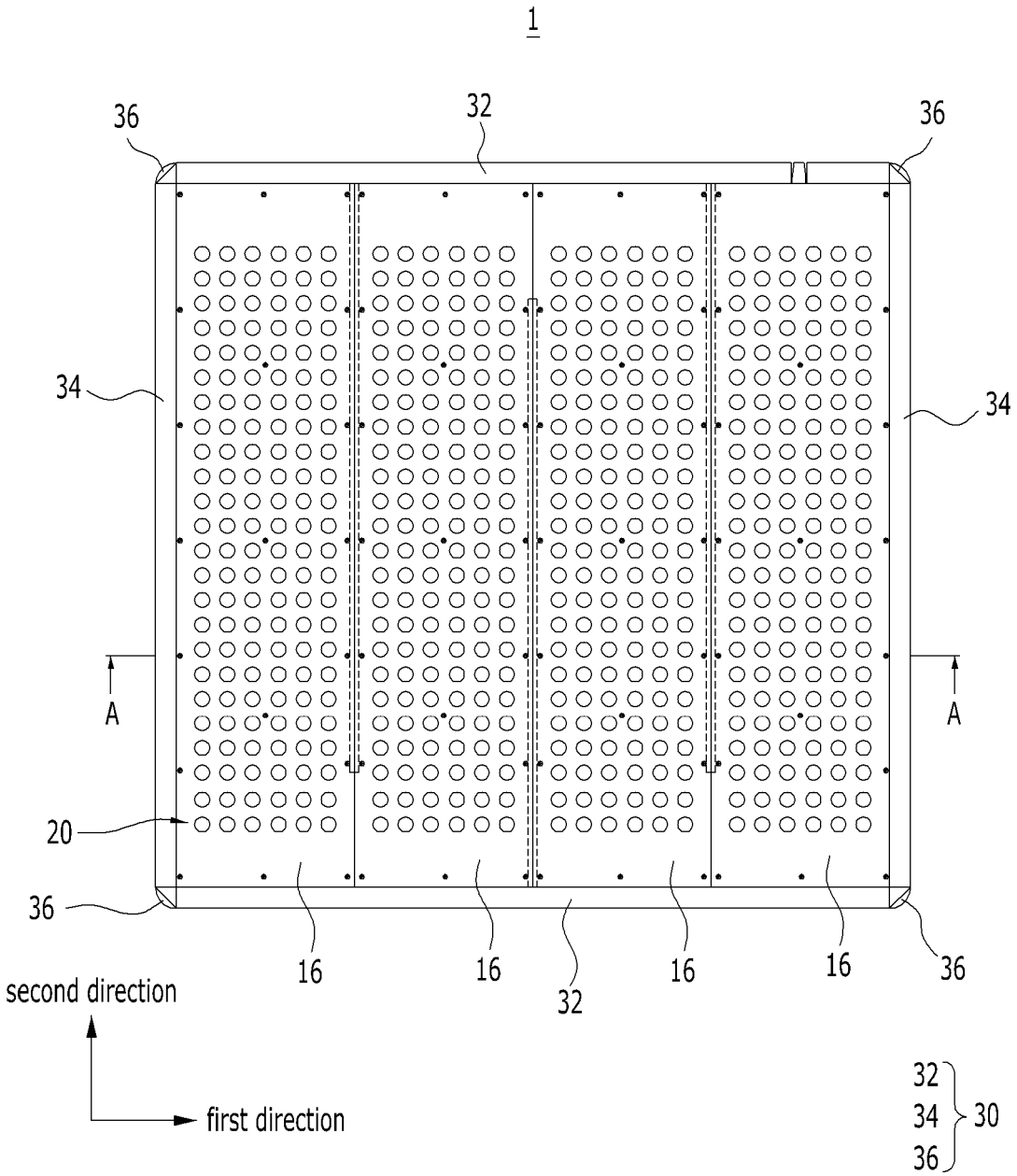
FIG. 7 is a top plan view of a state in which finishing upper plates are coupled to upper portions of the intermediate plates of FIG. 6.

FIG. 6 is a top plan view of a state in which intermediate plates are coupled to upper portions of a plurality of lower plates continuously connected to each other as shown in FIG. 5, and FIG. 7 is a top plan view of a state in which finishing upper plates are coupled to upper portions of the intermediate plates of FIG. 6.

Figure 8:
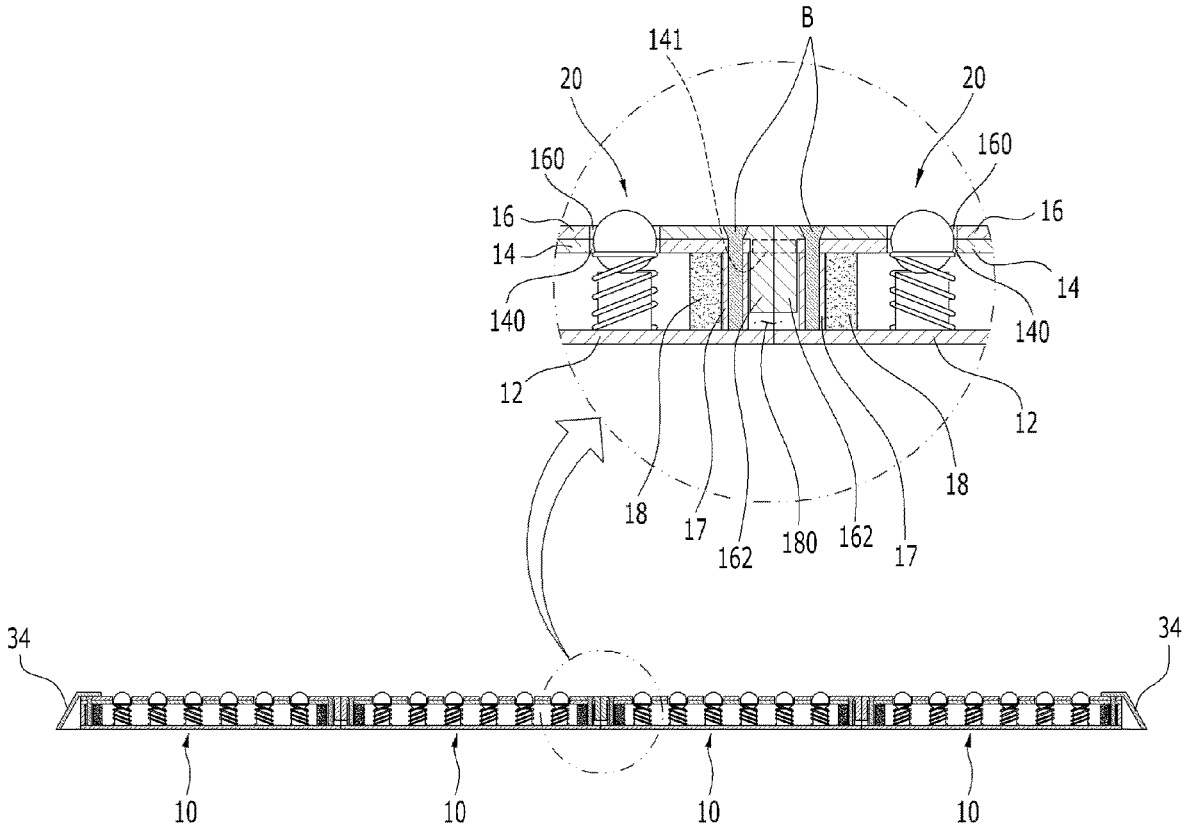
FIG. 8 is a cross-sectional view of a first direction (traverse direction) coupling and shows coupling relationships between components in a state in which the upper plates are coupled to the upper portions of the intermediate plates so as to cover the intermediate plates as shown in FIG. 7.

In addition, FIG. 8 is a cross-sectional view in the first direction (traverse direction) and shows coupling relationships between components in a state in which the upper plates are coupled to the upper portions of the intermediate plates so as to cover the intermediate plates as shown in FIG. 7. In other words, FIG. 8 is a cross-sectional view taken along line A-A of the dust suction mat shown in FIG. 7.

Referring to FIG. 6 to FIG. 8, recess parts 142 may be formed on opposite sides of two neighboring intermediate plates 14 so as to form a slit-shaped coupling hole 141 corresponding to the hollow part 180, and binding flanges 162 respectively formed on side edges, which are opposite to or in contact with each other, of two neighboring finishing upper plates 162 may be simultaneously inserted into the coupling hole 141 formed by the recess parts 142 so as to be positioned in the hollow part 180.

In FIG. 7, reference numeral 30 indicates a finishing member installed along outer edges of a dust suction mat in the form of an assembly in which unit mats 10 are continuously connected to each other in the first direction.

The finishing member 30 may include one pair of traverse finishing members 32 installed along the outer edges of the assembly type dust suction mat in the first direction, one pair of longitudinal finishing members installed along the outer edges of the assembly type dust suction mat in the second direction, and corner finishing members individually installed at corners of the assembly type dust suction mat where the traverse finishing members and the longitudinal finishing members meet.

Figure 9:
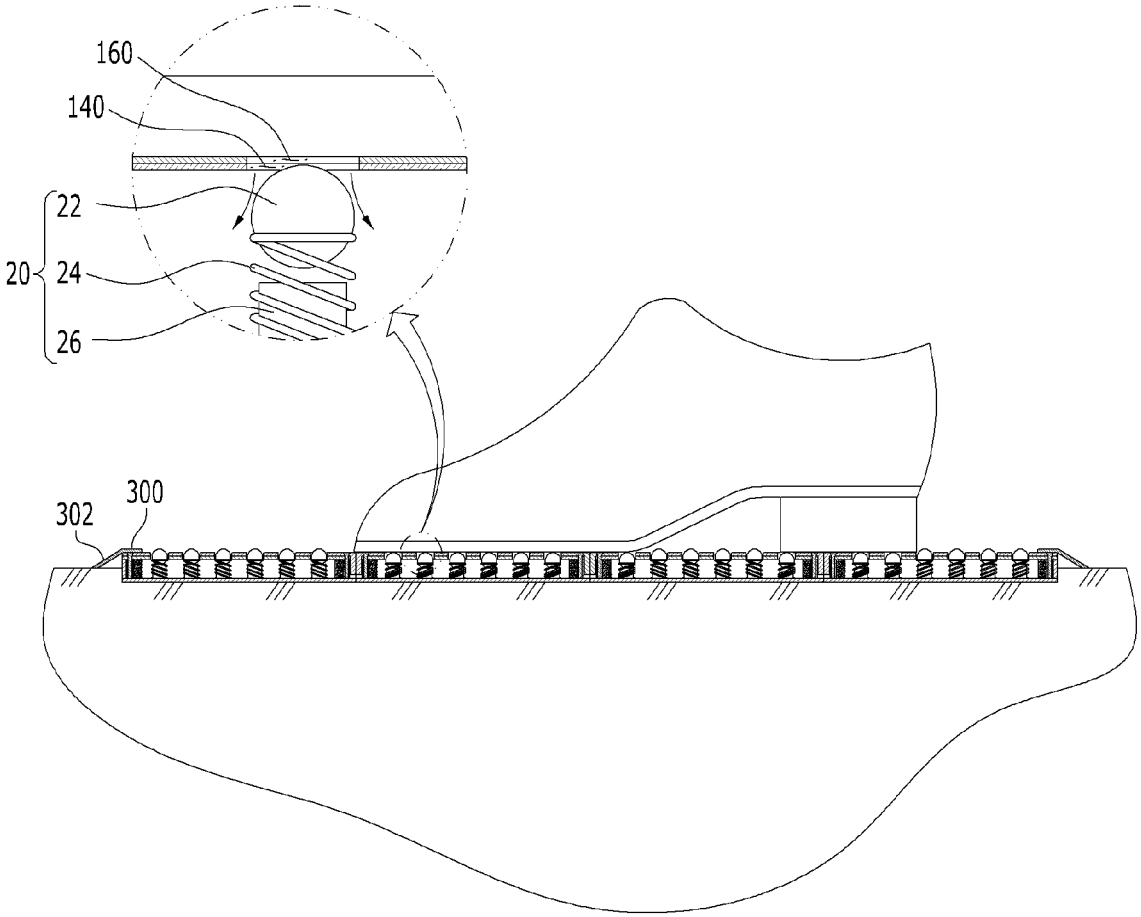
FIG. 9 is a view showing an operating state in a state in which a field-tailored prefabricated dust suction mat according to an embodiment of the present disclosure is installed on the bottom surface of an entrance.

Herein, as shown in FIG. 9 to be described later, each of the traverse finishing members 32, the longitudinal finishing members 34 and the corner finishing members 36 may include a connecting plate 300 in the form of a flat plate, and an inclination plate 302 tilted at a predetermined angle with respect to the connecting plate 300 so as to cover a step which may occur due to a difference in a height direction between a surface where the dust suction mat according to the embodiment of the present invention is to be installed and an uppermost surface of the dust suction mat.

FIG. 9 is a view showing operation in a state in which a field-tailored prefabricated dust suction mat according to an embodiment of the present disclosure is installed on the bottom surface of an entrance.

Referring to FIG. 9, when a person steps on the upper plates 16, the through hole opening/closing means 20 blocking the through holes 140, 160 with the parts exposed upward from the upper plates 16 are pressed down by the weight of the person, and thus the through holes 140, 160 are opened. In this state, the external suction force generating unit (not shown) is driven so that external air is suctioned through the open through holes 140, 160.

In this process, dust attached to the soles of the shoes of the person is suctioned into the mat through the open through holes 140 and removed, wherein the suctioned dust is moved to one side along the dust suction path P, discharged out of the dust suction mat through the dust discharge pipe 19 coupled to one side wall of the outer unit mat

10*a*, and filtered through a filtering unit (not shown) provided separately or in the form of a module in the suction force generating unit.

According to the field-tailored prefabricated dust suction mat according to the embodiments of the present disclosure as described above, owing to the prefabricated configuration in which the unit mats are assembled together, dust suction mats can be advantageously custom-made on site in various sizes according to site conditions such as surrounding environment or spatial situation of an installation site, consumers' requirements or the like.

In addition, even when dust suction mats are manufactured and shipped in the form of ready-made products in a factory, it is possible to quickly respond to site conditions or consumers' demands for size change advantageously, without extensive equipment replacement or change.

In the detailed description of the present disclosure above, only specific embodiments have been described.

However, it should be understood that the present disclosure is not limited to the special forms mentioned in the detailed description and includes all modifications, equivalents, and substitutes falling within the spirit and scope of the present disclosure as defined by the appended claims.

| Explanation of Reference Signs | |
|---|---|
| 1: dust suction mat | 10: unit mat |
| 10a: outer unit mat | 10b: intermediate unit mat |
| 12: lower plate | 13: rubber packing |
| 14: intermediate plate | 15: flow guide member |
| 16: upper plate | 17: fastening projections |
| 18: partition | 19: dust discharge pipe |
| 20: through hole opening/closing means | |
| 22: ball | |
| 24: spring | 26: spring support |
| 30: finishing member | |
| 32: traverse finishing member | |
| 34: longitudinal finishing member | |
| 36: corner finishing member | |
| 120: traverse side wall | |
| 122: longitudinal side wall | |
| 140, 160: through hole | |
| 141: coupling hole | 142: recess part |
| 162: binding flange | 180: hollow part |

What is claimed is:

1. A dust suction mat, comprising:

a plurality of unit mats detachably coupled to one another in a first direction, each unit mat having a plurality of through holes for dust suction and through hole opening/closing means for opening or closing the through holes, a length in a second direction perpendicular to the first direction, and a width in the first direction, wherein each unit mat comprises at least one internal side wall that is disposed at a boundary region between adjacent unit mats, wherein a central unit mat, disposed between a first adjacent unit mat and second adjacent unit mats, comprises:

a first internal side wall having an opening at a first boundary with the first adjacent unit mat; and a second internal side wall having a corresponding opening at a second boundary with the second adjacent unit mat and offset in the first direction from the opening in the first internal side wall, wherein the first internal side wall is laterally offset from the second internal side wall such that a solid portion of the second internal side wall is positioned directly opposite the opening of the first internal side wall, thereby defining a suction flow path with a plurality of substantially right-angled junctions forming a square wave pattern through the plurality of unit mats;

wherein each unit mat further comprises:

a lower plate in a rectangular shape with a length in the second direction greater than a width in the first direction, said lower plate having traverse side walls formed along both side edges in the first direction:

an intermediate plate in a shape substantially matching the lower plate, said intermediate plate having a plurality of through holes; and a finishing upper plate in a shape substantially matching the lower plate, wherein the finishing upper plate has a plurality of through holes matched corresponding to the through holes of the intermediate plate and covers the intermediate plate from a top of the intermediate plate; and wherein:

the internal side walls have their respective hollow parts extending in the second direction;

a plurality of recess parts are respectively formed on opposite sides of two neighboring said intermediate plates in the second direction so as to form respective slit-shaped coupling holes corresponding to the hollow parts; and a plurality of binding flanges are respectively formed on side edges of two neighboring said finishing upper plates in the second direction, wherein the binding flanges are disposed opposite to or in contact with each other and are simultaneously inserted through the coupling holes of the two neighboring intermediate plates and into the respective hollow parts.

2. The dust suction mat according to claim 1, wherein the unit mats include one pair of outer unit mats spaced apart from each other at a distance, and at least one or more intermediate unit mats positioned between the one pair of outer unit mats.

3. The dust suction mat according to claim 2, wherein each the unit mats further includes;

a plurality of fastening projections configured as spacers for separating the intermediate plate from the lower plate by a predetermined distance.

4. The dust suction mat according to claim 3, wherein the through hole opening/closing means are installed between the lower plate and the intermediate plate so as to match the through holes of the intermediate plate and the finishing upper plate one by one, and the through hole opening/closing means partially protrude upward from the top of the finishing upper plate through the through holes formed in the intermediate plate and the finishing upper plate.

5. The dust suction mat according to claim 4, wherein each of the through hole opening/closing means includes a ball disposed under the intermediate plate so as to correspond to the through holes of the intermediate plate and the finishing upper plate one by one, and a spring for applying elasticity to the ball at the bottom of the ball so that the ball comes into close contact with a corresponding through hole and a part of the ball protrudes upward from the top of the finishing upper plate.

6. The dust suction mat according to claim 3, wherein the lower plate of the outer unit mat further includes a longitudinal side wall formed along one side edge in the second direction, and rubber packings are attached to the longitudinal side wall and the traverse side wall so as to ensure airtightness along inner surfaces of the longitudinal side wall and the traverse side wall.

7. The dust suction mat according to claim 1, wherein a flow guide member is installed at a corner of a connection path part where two neighboring dust suction paths are connected to each other and has a curved concave guide surface.

8. The dust suction mat according to claim 1, further comprising a finishing member installed along outer edges of a dust suction mat in the form of an assembly in which the unit mats are continuously connected to each other in the first direction, wherein the finishing member includes one pair of traverse finishing members installed along the outer edges of the assembly type dust suction mat in the first direction, one pair of longitudinal finishing members installed along the outer edges of the assembly type dust suction mat in the second direction, and corner finishing members installed at corners of the assembly type dust suction mat where the traverse finishing members and the longitudinal finishing members meet.

* * * * *